US006383264B2

(12) United States Patent
Brown

(10) Patent No.: US 6,383,264 B2
(45) Date of Patent: May 7, 2002

(54) BIOMAGNETIC FILTER

(76) Inventor: Charles W. Brown, South Route. Box 107, Lavina, MT (US) 59046

( * ) Notice: Subject to any disclaimer, the term of this patent is extended or adjusted under 35 U.S.C. 154(b) by 0 days.

(21) Appl. No.: 09/837,211

(22) Filed: Apr. 19, 2001

Related U.S. Application Data

(60) Provisional application No. 60/203,481, filed on May 11, 2000.

(51) Int. Cl.[7] ..... B03C 1/00

(52) U.S. Cl. ..... 96/1; 55/495

(58) Field of Search ..... 96/1, 2, 3, 54, 96/55; 55/385.2, 495, 511; 210/222, 223

(56) References Cited

U.S. PATENT DOCUMENTS

| | | | | | |
|---|---|---|---|---|---|
| 263,131 | A | * | 8/1882 | Edison | 210/222 |
| 2,593,869 | A | | 4/1952 | Fruth | 183/7 |
| 3,471,023 | A | * | 10/1969 | Rosaen | 210/223 |
| 3,679,057 | A | * | 7/1972 | Perez | 210/223 |
| 4,888,113 | A | * | 12/1989 | Holcomb | 210/222 |
| 5,364,458 | A | * | 11/1994 | Burnett et al. | 55/496 |
| 5,407,469 | A | | 4/1995 | Sun | 96/62 |
| 5,607,497 | A | | 3/1997 | Brown | 95/3 |

* cited by examiner

*Primary Examiner*—David A. Simmons
*Assistant Examiner*—Frank M. Lawrence
(74) *Attorney, Agent, or Firm*—Patent & Trademark Services; Thomas Zack; Joseph H. McGlynn

(57) ABSTRACT

An air filtering system used to increase the filter capture efficiency of particulate matter carried in the air. Particulate matter carried in the air, such as in a furnace forced air system, receives a charge by contacting the duct's surface. As these charged particles move through conventional air filter material most are captured and retained in the material. To increase this capture rate of particulate matter, spaced magnetic strips are placed in the filter material in a generally parallel configuration. The polarity of the magnetic strips can be alternated to insure particles having positive of negative charges are slowed down, diverted, or both, as they flow through the filter material. The result of this action is an increase in the capture efficiency of the filter material. It is believed that the capture efficiency can be increased from about 87 percent with no magnetic strips to about 96 percent when strips are used. The filter system of this invention may be used in the duct work of an existing forced air furnace system. It could also be used as an air vent cover or as a pre-filter to a forced air furnace system. In one embodiment the strips were spaced 0.75 inches apart, however, the exact number and size of the inserted strips will depend on the particular system used.

6 Claims, 1 Drawing Sheet

BIOMAGNETIC FILTER

This invention claims the benefit of the U.S. Provisional application Ser. No. 60/203,481 filed on May 11, 2000.

BACKGROUND OF THE INVENTION

The present invention relates to an increased efficient air filter.

Many types of air filters are known. Some are simply mesh type filters wherein air carried particles passing through them are captured in the material making up the mesh. In other types of filters, such as electrostatic precipitators, a charge is applied to the moving particles and these charged particles are then attracted to an opposite charged surface. For example, in one filter system a rod is used having frayed strands of conducting wire protruding from the circumference of the rod to charge the particles.

In another earlier system an air ionizing apparatus is disclosed with one negatively charged member and a conductive strip which is positively charged. The conductive strip attracts the negative ions, causing them to be dispersed.

Still another related system discloses a personal dust sampler which can be attached to a user's clothing. Dust is captured by a charged PVC sheet.

DESCRIPTION OF THE PRIOR ART

Air filters can take on a variety of sizes, shapes and functioning characteristics. In mechanical type filters the material making up the mesh construct of the filter is used to capture and retain the undesired particles for later disposal. When it is desired to improve the particle capturing ability of the filter, electrostatic precipitators have been used to first electrically charge the moving air particles and then to capture these charged particles on an oppositely charged surface. These latter types of charged particle filters are generally know to have the ability to capture particles having considerably smaller sizes than those that can be captured in a mesh size dependent filter. For example, U.S. Pat. No. 2,593,669 to Fruth discloses a rod having frayed strands of conducting wire protruding from the circumference of the rod to charge the particles.

U.S. Pat. No. 5,407,469 to Sun discloses an air ionizing apparatus with one negatively charged member and a conductive strip which is positively charged. The conductive strip attracts the negative ions, causing them to be dispersed.

U.S. Pat. No. 5,607,497 to Brown discloses a personal dust sampler which can be attached to a user's clothing. Dust is captured by a charged PVC sheet.

In the present invention an air filter has a filtering medium with a plurality of parallel magnetic strips all as will be detailed in the specification that follows hereafter.

SUMMARY OF THE INVENTION

This invention relates to an air filter with spaced magnetic strips and an interposed filtering medium.

It is the primary object of the present invention to provide for an improved efficiency air filter.

Another object is to provide for such a filter in which a filtering medium has spaced generally parallel magnetic strips placed on different sides of the medium.

These and other objects and advantages of the present invention will become apparent to readers from a consideration of the ensuing description and the accompanying drawings.

DESCRIPTION OF THE PREFERRED EMBODIMENT

Figure 1:
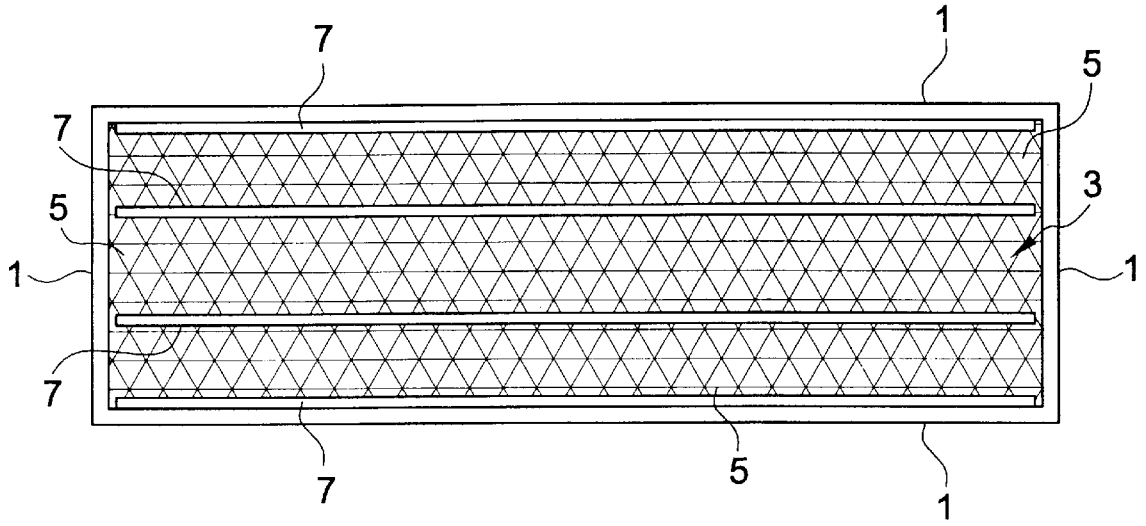
FIG. 1 is a top view of the present invention.

FIG. 1 is a top view of the present invention. A casing or frame 1 surrounds the material making up the filter 3 on four sides. The two opposite side of the frame 1 are left opened to permit flow air to pass through the enclosed filter material. Almost any type of material, like card board, can be used to make the rectangular shaped frame 1. Within the confines of the frame is the material 3 used to filter the flowing air.

The filter material 3 consists of a filtering medium 5 and interposed magnetic strips 7. There are four spaced generally parallel strips 7 shown in this embodiment. Located between the strips is the conventional filtering material 5 formed of three separate bats of filtering material such as a fiberglass material or other type of mesh material used to retain caught air flowing particles.

Air moving through the air in ducts creates an electric charge which attaches to the particulate matter. These charged particles are then attracted to and repelled from the magnetic strips due to chosen polarity of the chosen strips. For example, if one strip has a given magnetic polarity, such as positive, the adjacent parallel strip can be selected to have an opposite polarity. It this way regardless of what the induced charge is on the flowing airborne particle, one of the magnetic strips can possibly effect the particle's flow through the filter material 5. As a charged particle, under the force of magnetic attraction or repulsion, moves towards a controlling strip it is more likely to be captured by the mesh material 5 and retained in this material for later disposal.

In forced air heating and air conditioning systems, conventional high quality mesh filters can reduce particulate matter from air ducts by about 87 percent. The relatively fast flowing charged particles can be slowed down or diverted, or both, by the magnetic strips of this invention thereby making for an increased likelihood that the filter material 5 will do its intended work and the particle will not flow through the filter. The present invention increases the efficiency of particulate removal to around 96 percent. Additionally, the filter system of the present invention need not be restricted to use in a forced air system. It could be set up as a stand alone unit having its own fan to reduce particulate matter from the air in a room.

Figure 2:
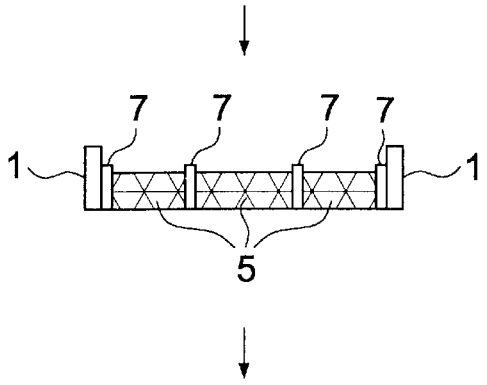
FIG. 2 is a side view of the filter shown FIG. 1.

FIG. 2 is a side view of the filter shown FIG. 1. The arrow indicates the flow of air through the filter material 3. The flowing air carries the particulate matter to be removed. As this air moves the carried particles are charged and these charged particles enter the filter material 3. The magnetic strips 7 either attract or repel the flowing charged particulate matter depending on their charge, which diverted particles can then be captured by the filter material 5. In one embodiment the parallel magnetic strips 7 were spaced 0.75 of an inch apart. The filtering material 5 was interposed in any available spacing between adjacent strips to act as a particle capturing medium. If desired, a single bat of filtering material can have these magnetic strips embedded in its material rather than using separate bats of filter material.

Another possible use of the present invention is to place a unit such at the one shown in FIGS. 1 and 2 over a room air vent just before the forced air from a forced air furnace enters a room. Another way the filter system could be used is as a pre-filter of air going into a forced air furnace. Many different sizes and spacing between the strips can be used as desired based on the particular use for the filter system.

Although the preferred embodiment of the present invention and the method of using the same has been described in the foregoing specification with considerable details, it is to be understood that modifications may be made to the invention and modified forms of the present invention done by others skilled in the art to which the invention pertains.

What I claim as my invention is:

1. A filter system comprising:

a frame for retaining filter material, said frame being adapted to be mounted within the duct work of a forced air system;

a filter mounted within said frame, said filter consisting of an air filtering material with interposed spaced magnetic strips of material, at least some of said magnetic strips being of different magnetic polarities from other strips whereby the magnetic strips can attract particulate matter charged with different polarities flowing in the duck work of a force air system.

2. The system as claimed in claim 1, wherein said magnetic strips are generally parallel to each other in the filter material and have alternate different polarities.

3. The system as claimed in claim 2, wherein the air filter material comprises fiberglass material.

4. The system as claimed in claim 3, wherein there are four magnetic strips of alternate different polarities, each of said strip being spaced less an one inch apart from an adjacent strip.

5. The system as claimed in claim 4, wherein said frame is rectangular and encloses the filter on four sides.

6. The system as claimed in claim 5, wherein said frame is made of a paper product material.

* * * * *